US010350664B2

(12) United States Patent
Chiriac et al.

(10) Patent No.: US 10,350,664 B2
(45) **Date of Patent: *Jul. 16, 2019**

(54) FURNACE ASSEMBLY AND METHOD FOR HOT-STAMPING VEHICLE COMPONENTS

(71) Applicant: FORD GLOBAL TECHNOLOGIES, LLC, Dearborn, MI (US)

(72) Inventors: Constantin Chiriac, Windsor (CA); Raj Sohmshetty, Canton, MI (US); Peter A. Friedman, Ann Arbor, MI (US); S. George Luckey, Dearborn, MI (US); Nia R. Harrison, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 294 days.

This patent is subject to a terminal disclaimer.

(21) Appl. No.: 15/198,181

(22) Filed: Jun. 30, 2016

(65) Prior Publication Data

US 2018/0001367 A1 Jan. 4, 2018

(51) Int. Cl.
*B21D 22/02* (2006.01)
*B21D 47/01* (2006.01)

(52) U.S. Cl.
CPC ..... *B21D 22/022* (2013.01); *B21D 47/01* (2013.01)

(58) Field of Classification Search
CPC ..... C21D 2221/01; B21D 22/022; F27D 5/00; F27D 1/18
USPC ..... 266/249; 432/250
See application file for complete search history.

(56) References Cited

U.S. PATENT DOCUMENTS

| | | | | |
|---|---|---|---|---|
| 7,578,894 | B2 | 8/2009 | Reinhold et al. | |
| 8,460,484 | B2 | 6/2013 | Loecker et al. | |
| 8,529,250 | B2 | 9/2013 | Schwartz | |
| 8,691,032 | B2 | 4/2014 | Thomas et al. | |
| 2004/0060623 | A1 | 4/2004 | Boke et al. | |
| 2010/0300584 | A1 | 12/2010 | Buschsieweke et al. | |
| 2013/0160906 | A1 | 6/2013 | Bake et al. | |
| 2013/0313763 | A1 | 11/2013 | Grewe | |
| 2014/0083572 | A1 | 3/2014 | Schwartz | |
| 2015/0225189 | A1* | 8/2015 | Ebner | B21J 1/06 72/419 |
| 2017/0304884 | A1* | 10/2017 | Sohmshetty | B21D 22/208 |
| 2018/0001367 | A1* | 1/2018 | Chiriac | B21D 47/01 |

FOREIGN PATENT DOCUMENTS

DE 10 2013 107 870 A1 1/2015

* cited by examiner

*Primary Examiner* — Scott R Kastler
(74) *Attorney, Agent, or Firm* — Raymond L. Coppiellie; Brooks Kushman P.C.

(57) ABSTRACT

A furnace assembly for hot-stamping vehicle components includes a support structure, a movable visor, a heat element, and a set of blocks. The support structure defines a cavity and an opening sized to receive a blank. The movable visor is mounted to the support structure and defines a first zone partially open to the cavity via the opening. The heat element is disposed within the cavity. Each of the blocks of the set of blocks is disposed on one side of the heat element to define a second zone and aligned with the opening to receive a vehicle component blank upon the blocks. The set of blocks and visor are arranged with one another such that portions of the blank are heated at different temperatures in the first zone and the second zone.

16 Claims, 5 Drawing Sheets

FURNACE ASSEMBLY AND METHOD FOR HOT-STAMPING VEHICLE COMPONENTS

TECHNICAL FIELD

This disclosure relates to a furnace assembly and a method for hot-stamping vehicle components.

BACKGROUND

Reducing weight of a vehicle component is one example of an area in which automotive manufacturers are exploring methods to improve fuel economy for vehicles. This exploration may include using dissimilar materials for various vehicle components which may need to be secured to one another. Examples of dissimilar materials include ultrahigh strength steel (UHSS) and press hardenable steel (PHS) aluminum alloys. Utilization of dissimilar materials, however, has limitations during joining processes. For example, riveting PHS and aluminum alloys may present challenges due to high strength/low ductility of the steel after hot stamping.

SUMMARY

A furnace assembly for hot-stamping vehicle components includes a support structure, a movable visor, a heat element, and a set of blocks. The support structure defines a cavity and an opening sized to receive a blank. The movable visor is mounted to the support structure and defines a first zone partially open to the cavity via the opening. The heat element is disposed within the cavity. Each of the blocks of the set of blocks is disposed on one side of the heat element to define a second zone and aligned with the opening to receive a vehicle component blank upon the blocks. The set of blocks and visor are arranged with one another such that portions of the blank are heated at different temperatures in the first zone and the second zone. The heat element may be arranged adjacent the first zone such that a portion of the vehicle component blank disposed therein is heated at a temperature below a phase transformation temperature of the vehicle component blank. The heat element may be arranged within the second zone such that a portion of the vehicle component blank disposed therein is heated at a temperature above a phase transformation temperature of the vehicle component blank. One or more rollers may extend between the set of blocks and may be located above the heat element. The visor may further define a pass-through sized to receive the vehicle component blank. A plug may be sized for insertion within the pass-through and to prevent access to the first zone. Flaps may be mounted to the support structure at the opening such that the opening is sized to receive the vehicle component blank. The visor may be mounted to the support structure for pivotal movement between at least an open position and a closed position. The visor may be mounted to the support structure for slidable translation between at least an open and a closed position.

A furnace includes a housing, a visor, and a slide mechanism. The housing defines a chamber having an opening. The visor is pivotally secured to the housing adjacent the opening and defines a first zone external to the chamber. The slide mechanism defines a second zone internal to the chamber and arranged for a blank to extend through the first and second zones such that portions of the blank receive different temperature heat from a heat element based on the zone. The slide mechanism may include a set of walls, a set of blocks, and one or more rollers. The set of walls may be disposed on either side of the heat element mounted to a base portion of the housing within the chamber. Each block of the set of blocks may be sized for mounting to one of the walls. The one or more rollers may extend between the blocks to translate the blank within the second zone. A divider may define one or more cutouts to receive a portion of each wall of the set of walls and a divider opening sized to receive the blank, wherein the divider is sized for translation along the set of walls and such that the divider separates the second zone into two zones. The divider may be arranged with the visor for a blank to extend through the first zone and each of the two zones of the second zone. The divider may be translatable along the set of walls to define multiple sizes of the two zones of the second zone. The visor may further define a visor opening sized to receive the blank. A visor plug may be sized for insertion within the visor opening. A first flap and a second flap may extend from portions of the housing at the opening to define a pass-through sized for the blank to extend therethrough. The heat element may be arranged with the visor such that a temperature of the first zone is below a phase transformation temperature of the blank.

A method to hot-stamp a vehicle component includes positioning a vehicle component blank within a first heat zone defined by a visor externally mounted to a furnace such that such that a first portion of the vehicle component blank is disposed within the first heat zone and a second portion of the vehicle component blank is disposed within a second heat zone defined by the furnace. The method also includes heating the first heat zone to a temperature selected to be below a phase transformation temperature of the vehicle component blank. The method further includes heating the second heat zone to a temperature selected to be above a phase transformation temperature of the vehicle component blank and stamping the vehicle component blank based on a predetermined vehicle component design. The vehicle component blank may be positioned upon a slide mechanism disposed within the furnace and further defining the second zone.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
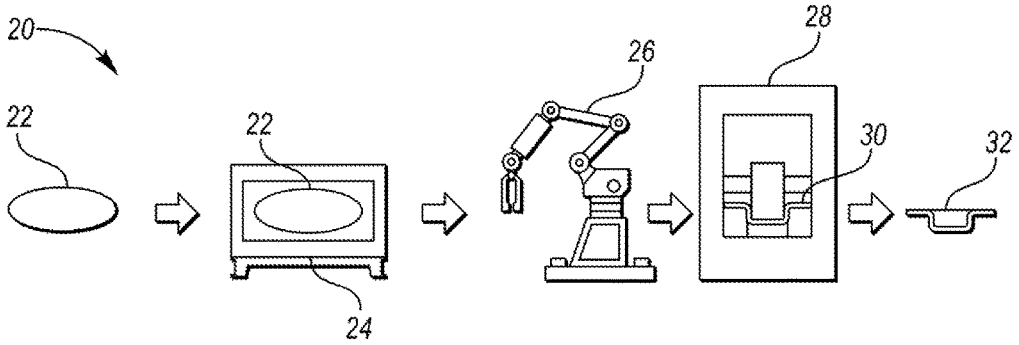
FIG. 1 illustrates an example of a hot-stamping process.
Figure 2:
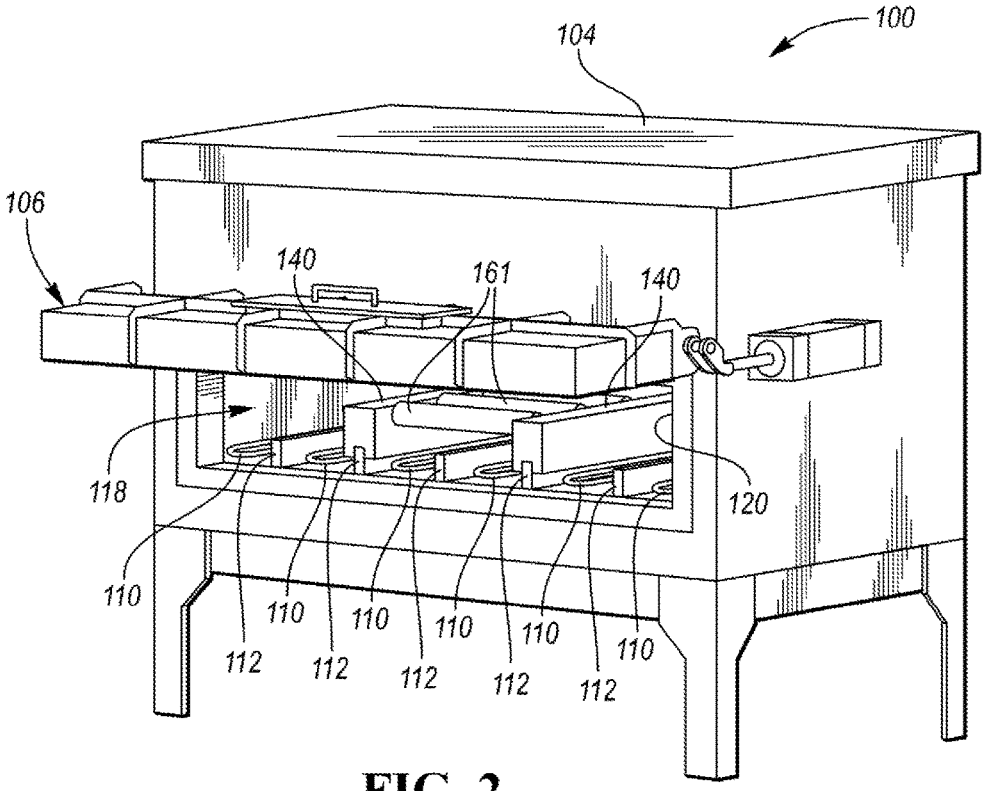
FIG. 2 is a perspective view of an example of a furnace assembly for hot-stamping vehicle components.
Figure 3:
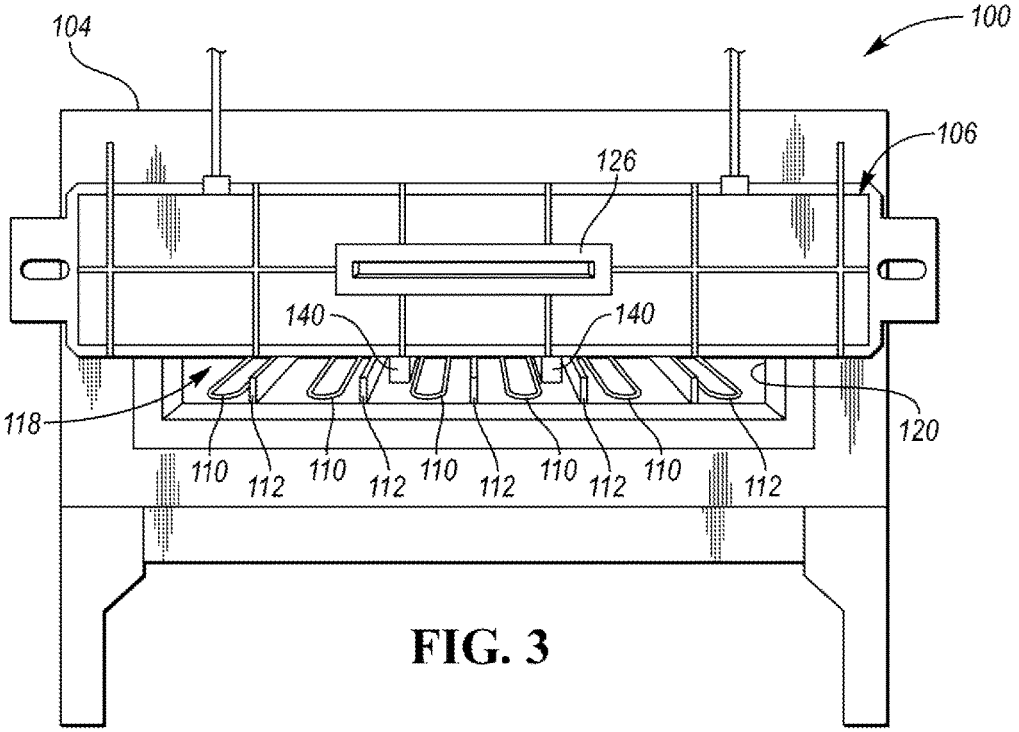
FIG. 3 is a front view of the furnace assembly of FIG. 2 showing a visor component mounted for translation.
Figure 4:
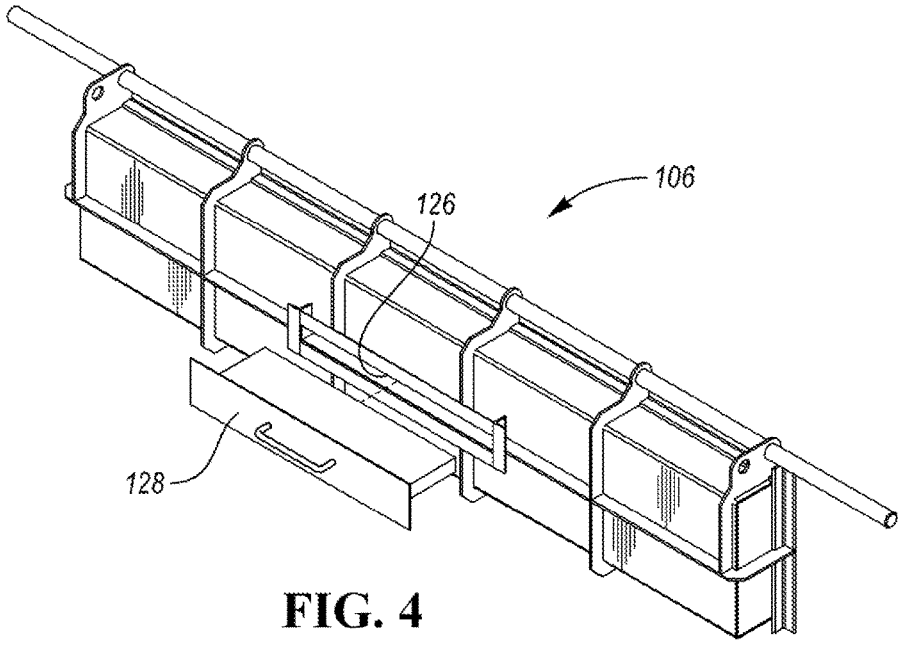
FIG. 4 is a perspective view of an example of a visor of the furnace assembly of FIG. 2 for pivotally mounting to a housing of the furnace assembly.

FIG. 1 shows an example of a hot-stamping process for manufacturing an UHSS vehicle body component, referred to generally as a hot-stamping process 20 herein. Hot-stamping, also known as hot forming or press hardening, is a process of stamping a blank while the metal is very hot, usually in excess of 900° C., and subsequently quenching the formed blank in a closed die. The hot-stamping process may convert low-strength blanks to high-strength components. For example, the finished component may have a yield strength of about 150 to 230 kilo pounds per square inch (KSI).

In hot-stamping process 20, a boron steel blank 22 (which may be a press-hardenable steel) is placed in a furnace 24 and heated above a above a phase transformation temperature (AC3) forming austenite. AC3 is the transformation temperature at which ferrite fully transforms into austenite. For example, the blank 22 may be heated at 900 to 950° C. for a predetermined time in the furnace 24. The bake time and furnace temperature may vary depending on the material of the blank 22 and desired properties of the finished part. After heating, a robotic transfer system 26 may transfer the blank 22, now austenized, to a press 28 having a die arrangement 30. The die arrangement 30 stamps the blank 22 into a desired shape while the blank 22 is still hot to form one or more components 32 from the blank 22. The component 32 is then quenched while the die 30 is still closed using water or other coolant. Quenching is provided at a cooling speed of 20 to 150° C./sec. for a predetermined duration at the bottom of the stroke. Quenching changes the microstructure of the blank from austenite to martensite. After quenching, the component 32 is removed from the press 28 while the component is still hot (e.g., about 150° C.). The component 32 may then be cooled on racks.

A hot-stamping process may provide numerous advantages over other high-strength steel forming methods such as cold-stamping. One advantage of hot-stamping a is reduced spring back and warping of the blank. Hot-stamping also allows complex shapes to be formed in a single stroke of the die to reduce downstream processing and increase efficiency in the manufacturing of the vehicle component from the blank.

Hot-stamped components have found broad application in the automotive industry. Hot-stamping components are both lightweight and strong. Example automotive components formed by hot-stamping may include: body pillars, rockers, roof rails, bumpers, intrusion beams, carrier understructure, mounting plates, front tunnels, front and rear bumpers, reinforcement members, side rails, and other parts that are designed to resist deformation during an impact.

Hot-stamped components may be difficult to join to other components. For example, a hot-stamped component may need to be fastened to another component via a self-piercing rivet. Due to high strength and low ductility, it may be difficult for the rivet to penetrate through the martensite microstructure of the hot-stamped component.

In order to solve these and other problems, a furnace may be structured heat portions of the blank at different temperatures to form softened zones in the blank at select locations. These softened zones may remain soft during the stamping and quenching phases and are also present in the finished component. The softened zones are specifically placed in locations where the component is to be attached to other components. The softened zones may have a microstructure consisting of ferrite and perlite, which have lower yield strength and a higher ductility as compared to martensite. For example, the softened zones may have 30-40% less yield strength, and 30-40% more ductility. A self-piercing rivet can more easily penetrate through the softened zones due to the lower yield strength and the higher ductility present in the zone. Material properties of the softened zones may also facilitate welding of a press-hardened component to mild-steel or aluminum components. "Softened zone" or "soft zone" as used herein shall be construed to mean any area of a component that is not fully austenized.

Steel must be fully austenized in order to from martensite. If portions of the blank remain below AC1, then martensite will not be formed in those areas during quenching. Thus, the softened zones can be created by not heating the zones above the phase transformation temperature at which austenite begins to form (AC1). An example AC1 temperature is 800° C.

FIGS. 2 through 7 show an example of a variable heat furnace assembly, referred to generally as a furnace assembly 100. The furnace assembly 100 may include a housing 104, a visor 106, one or more lower heat elements 110, and one or more walls 112 each disposed between adjacent lower heat elements 110. Optionally, one or more upper heat elements 114 may be spaced from the one or more lower heat elements 110. The housing 104 may also be referred to as a support structure herein. The housing 104 defines a housing cavity 118 and an opening 120 open to the housing cavity 118.

The visor 106 may define a visor passthrough 126. The visor passthrough 126 may be sized for a blank, such as a blank for a vehicle component, to extend therethrough. A plug 128 may be sized for insertion within the visor passthrough 126. The visor 106 may be mounted to the housing 104 for pivotal movement. For example, the visor 106 may be mounted such that the visor 106 may move between at least open and closed positions. Alternatively, the visor 106 may be mounted for vertical translation relative to the housing 104 and to move between open and closed positions (shown in FIG. 3). Access to the housing cavity 118 is provided when the visor 106 is in the open position. Access to the housing cavity 118 is prevented except via the visor passthrough 126 when the visor 106 is in the closed position. It is contemplated that the visor 106 may have more than one visor passthrough 126 to accommodate more than one vehicle component blank. The visor 106 may define a visor cavity 132 therein. The visor cavity 132 may also be referred to as a first heat zone herein.

A set of blocks 140 may be mounted to two of the one or more walls 112. For example, each block of the set of blocks 140 may define a channel extending along a length of the block 140. The channel may be sized to receive a portion of one of the walls of the one or more walls 112. The one or more lower heat elements 110 and the one or more upper heat elements 114 may span a width of the cavity 118. The one or more lower heat elements 110 may be mounted to a base portion of the housing 104 within the housing cavity 118. The one or more upper heat elements 114 may each include opposite ends mounted to an internal surface of the housing 104 within the housing cavity 118. The one or more lower heat elements 110, the one or more upper heat elements 114, and the set of blocks 140 may be spaced from one another to define a second heat zone therebetween. Alternatively, the one or more lower heat elements 110 and the set of blocks 140 may be arranged with one another to define the second heat zone.

Figure 5:
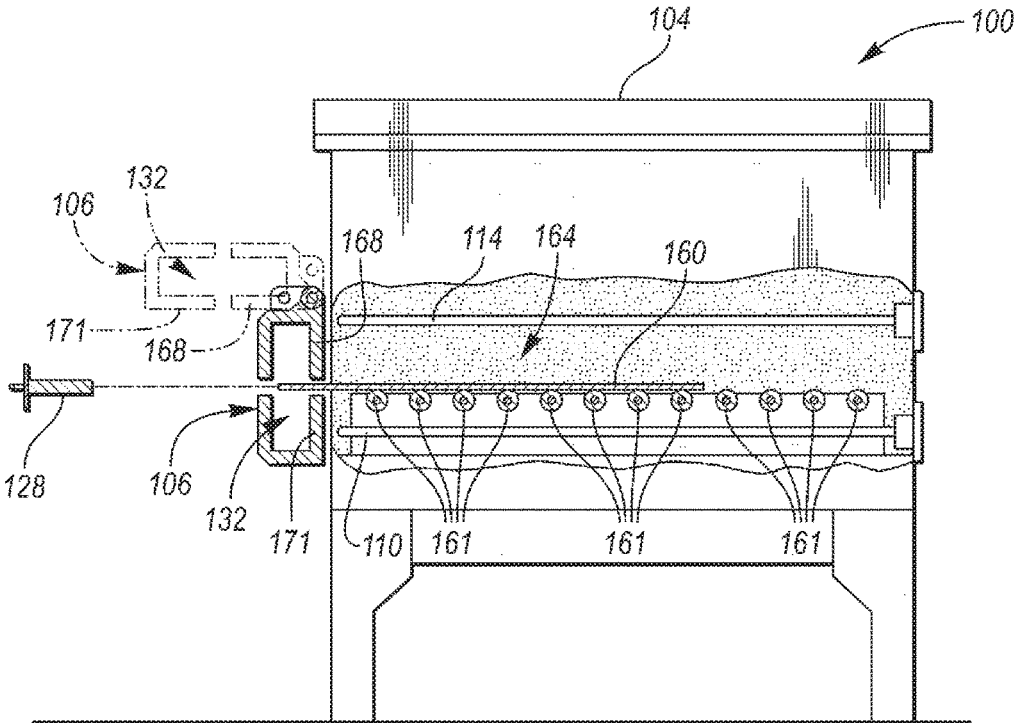
FIG. 5 is a side view of the furnace assembly of FIG. 2 with portions cut away to show hidden components.

The heat elements may be arranged relative to the first heat zone and the second heat zone to heat portions of a vehicle component blank at different temperatures. Optionally, a visor heat element (not shown) may be located within or mounted to the visor 106. For example, FIG. 5 shows a side view of the furnace assembly 100 with portions partially cut away to show hidden components. In this example, the visor 106 is shown mounted to the housing 104 for vertical translation. A vehicle component blank 160 is shown extending through the first heat zone within visor cavity 132 and a second heat zone 164. The second heat zone 164 is within the housing cavity 118. A first flap 168 and a second flap 171 may be secured to the housing 104 or the visor 106 to define an opening sized for the vehicle component blank 160 to extend through. It is also contemplated that the first flap 168 and the second flap 171 may be a single component. The heat zones and the housing 104 may be arranged with one another such that a first portion of the vehicle component blank 160 disposed within the first heat zone may receive heat at a lower temperature than a second portion of the vehicle component blank 160 disposed within the second heat zone 164.

For example, the heat elements may heat the first portion of the vehicle component blank 160 at a temperature below a phase transformation temperature to create a soft zone of the vehicle component blank 160. A microstructure of the soft zone may consist of ferrite and perlite. The heat elements may heat the second portion of the vehicle component blank 160 at a temperature above the phase transformation temperature to create tailored properties of the vehicle component blank 160. A microstructure of the portion of the vehicle component blank 160 heated above the phase transformation temperature may consist of martensite and bainite.

Figure 6:
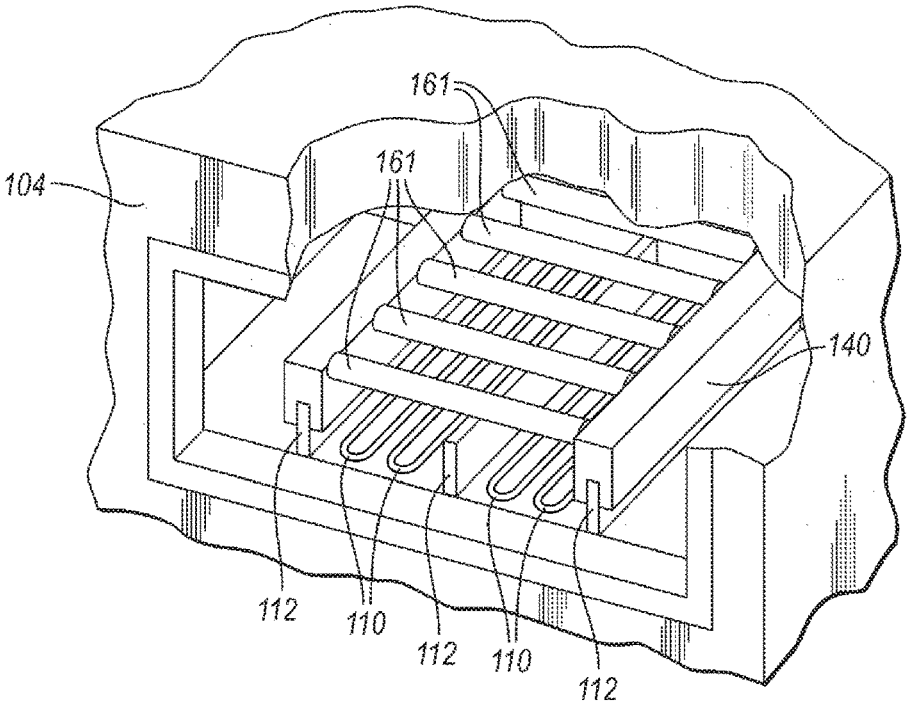
FIG. 6 is a perspective view of the furnace assembly of FIG. 2 with portions of the furnace assembly removed to show internal components thereof.
Figure 7:
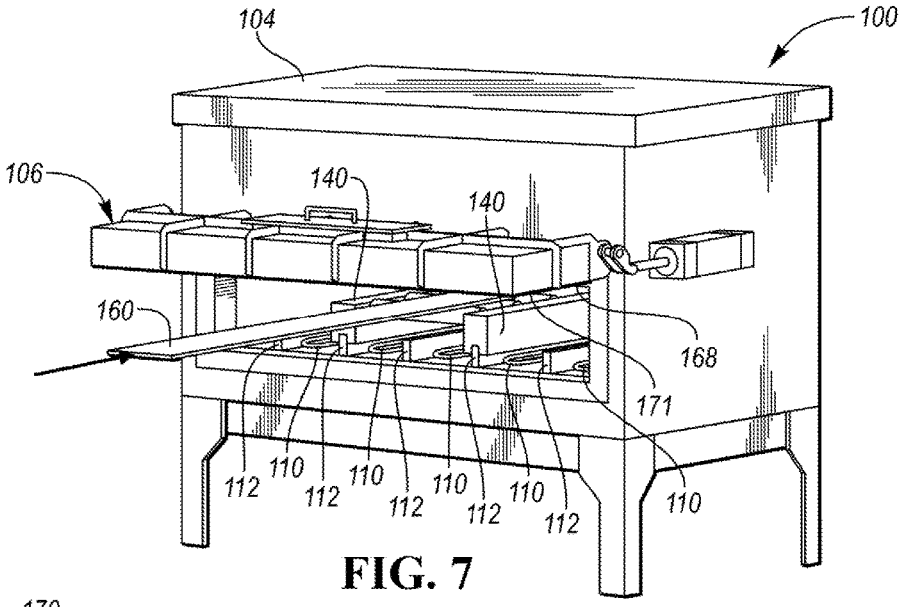
FIG. 7 is a perspective view of the furnace assembly of FIG. 2 showing a blank prior to insertion within the furnace assembly.

FIG. 6 shows an example of a slide mechanism including the set of blocks 140. The slide mechanism may assist in translating a vehicle component blank within the housing 104. For example, one or more rollers 161 may extend between each block of the set of blocks 140. The one or more rollers 161 may be aligned with the opening 120 of the housing 104 such that a blank may slide along the one or more rollers 161 to orient the blank within the housing 104 and relative to the heat elements. Each block of the set of blocks 140 may be removable relative to the walls of the set of walls 112 such that the slide mechanism may be positioned in various configurations within the housing 104. FIG. 7 shows an example in which the vehicle component blank 160 is aligned with the visor passthrough 126 for insertion into the housing 104.

Various selective heating technologies may be applied to blanks such as the vehicle component blank 160 via the furnace assembly 100. A first selective heating technology may be used in a scenario in which desired vehicle components have a non-coated steel or aluminized coated steel which do not require a predetermined weldability condition in subsequent or assembly operations. In this example, the vehicle component blank 160 may be of a PHS material in which portions thereof are heated at different temperatures. The desired soft zone is heated below the phase transformation temperature and the rest of the vehicle component blank 160 is heated at a temperature above the phase transformation temperature. The soft zone will exhibit low strength and high ductility and a microstructure thereof will include recrystallized ferrite and perlite while the rest of the vehicle component blank 160 will exhibit high strength with a fully martensitic microstructure.

A second selective heating technology may be used in a scenario in which desired vehicle components are of an aluminized coated steel requiring good weldability conditions for subsequent or assembly operations. In this example, the vehicle component blank 160 is heated above the phase transformation temperature to produce an alloying layer for weldability requirements. After the alloying layer is formed an area in which soft zone properties is desired may be moved to a position within the furnace that provides a slow cooling rate for a remainder of soaking time. The whole vehicle component blank 160 may then undergo an in-die hot-forming operation at the end of the soaking time when thermodynamic conditions for producing the soft zone have been reached. After the hot forming, a microstructure of the soft zone area will include exhibit ferrite and perlite. The rest of the vehicle component blank 160 will have a fully martensitic microstructure.

Figure 8:
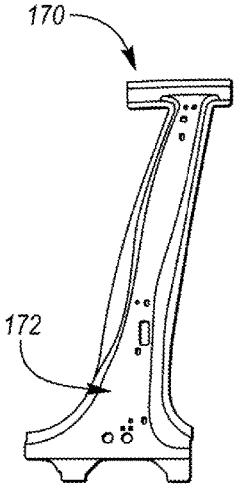
FIG. 8 is a front view of an example of a vehicle component which may be created in part by the furnace assembly of FIG. 2.

FIG. 8 shows an example of a vehicle component following the hot-stamping process using a furnace capable of variable heating as described above, referred to generally as a vehicle component 170. In this example, the vehicle component 170 is a pillar component for a vehicle. Structural details of the vehicle component 170 may be shaped via stamping following the hot forming process. The vehicle component 170 has a soft zone 172. The rest of the component corresponds to the portion of the vehicle component 170 which was heated above the phase transformation temperature in heat zone two and may be mostly made of a UHSS material including a fully martensite crystal structure. The vehicle component 170 may be secured to another component by using a self-piercing rivet in the soft zone 172. The soft zone 172 may be made up of perlite and/or ferrite. The soft zone 172 may correspond to a portion of the vehicle component blank 160 which was disposed in heat zone one for heating below the phase transformation temperature.

Figure 9:
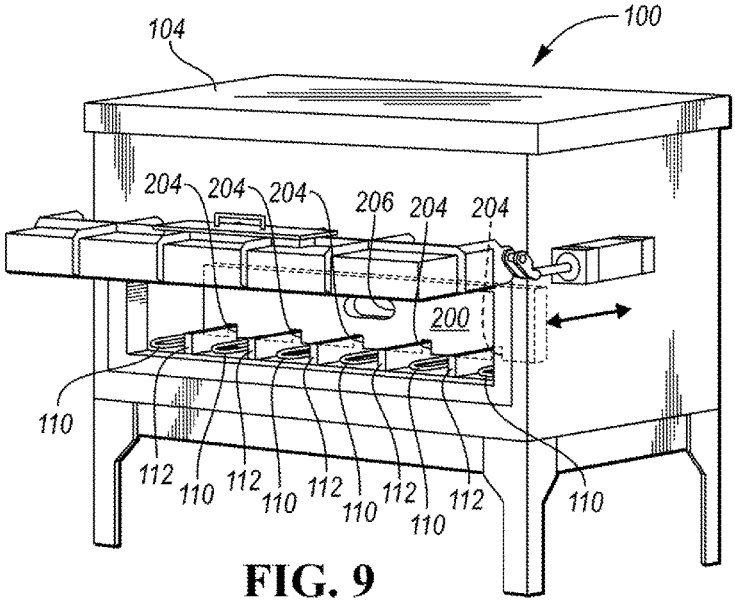
FIG. 9 is a perspective view of an example of a divider which may be mounted within the furnace assembly of FIG. 2 for translation.

FIG. 9 shows an example of a divider for the furnace assembly 100, referred to generally as a divider 200. The divider 200 may define one or more cutouts 204 sized to receive a portion of each wall of the one or more walls 112. The divider 200 may separate a heat zone, such as the second heat zone 164, into two different heat zones. The divider 200 may translate along the one or more walls 112 to adjust a size of the two heat zones of the second heat zone. The divider 200 may define a divider opening 206 sized to receive the vehicle component blank 160 and arranged with the housing 104 to orient the vehicle component blank 160 for extension through the various heat zones.

Figure 10:
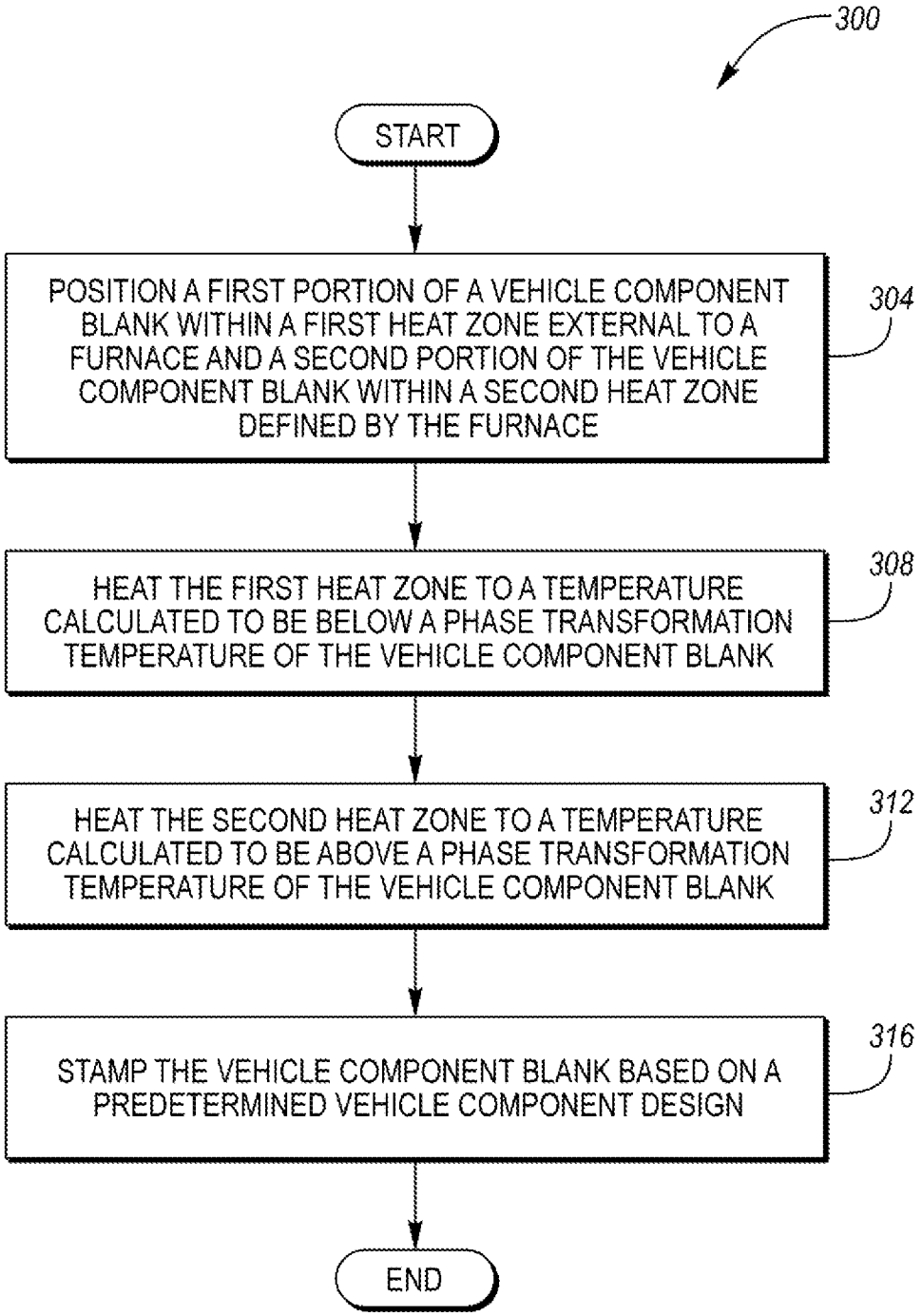
FIG. 10 is a flow chart illustrating an example of a method to hot-stamp a vehicle component.

FIG. 10 is a flow chart illustrating an example of a method to hot-stamp a vehicle component, referred to generally as a process 300 herein. In operation 304, a vehicle component blank may be positioned within a furnace such that a first portion of the vehicle component blank is disposed within a first heat zone and a second portion of the vehicle component blank is disposed within a second heat zone. Optionally, the second portion of the vehicle component blank may be supported by a slide mechanism disposed within the furnace and further defining the second heat zone. One or more heat elements of furnace may be activated to adjust a temperature of the first heat zone to a temperature below a phase transformation temperature of the vehicle component blank in operation 308. In operation 312, the one or more heat elements may be activated to adjust a temperature of the second heat zone to a temperature above the phase transformation temperature of the vehicle component blank. In operation 316, the vehicle component blank may be stamped based on a predetermined vehicle component design. For example, the vehicle component blank may be formed into the vehicle component 170 shown in FIG. 8.

While various embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to marketability, appearance, consistency, robustness, customer acceptability, reliability, accuracy, etc. As such, embodiments described as less desirable than other embodiments or prior art implementations with respect to one or more characteristics are not outside the scope of the disclosure and can be desirable for particular applications.

What is claimed is:

1. A furnace assembly for hot-stamping vehicle components comprising:
- a support structure defining a cavity and an opening sized to receive a vehicle component blank;
- a movable visor mounted to the support structure and defining a first zone partially open to the cavity via the opening and defining a visor opening sized to receive the vehicle component blank;
- a heat element disposed within the cavity; and
- a set of blocks, each disposed on one side of the heat element to define a second zone and aligned with the opening to receive the vehicle component blank upon the blocks,
- wherein the set of blocks and visor are arranged with one another such that portions of the vehicle component blank are heated at different temperatures in the first zone and the second zone.

2. The assembly of claim 1, wherein the heat element is arranged adjacent the first zone such that a portion of the vehicle component blank disposed therein is heated at a temperature below a phase transformation temperature of the vehicle component blank.

3. The assembly of claim 1, wherein the heat element is arranged within the second zone such that a portion of the vehicle component blank disposed therein is heated at a temperature above a phase transformation temperature of the vehicle component blank.

4. The assembly of claim 1 further comprising one or more rollers extending between the set of blocks and located above the heat element.

5. The assembly of claim 1, further comprising a plug sized for insertion within the visor opening and to prevent access to the first zone.

6. The assembly of claim 1, wherein the movable visor further comprises flaps mounted to the support structure at the opening such that the opening is sized to receive the vehicle component blank.

7. The assembly of claim 1, wherein the visor is mounted to the support structure for pivotal movement between at least an open position and a closed position.

8. The assembly of claim 1, wherein the visor is mounted to the support structure for slidable translation between at least an open and a closed position.

9. A furnace comprising:
- a housing defining a chamber having an opening;
- a visor pivotally secured to the housing adjacent the opening and defining a visor opening sized to receive a blank and defining a chamber external zone; and
- a slide mechanism defining a chamber internal zone and arranged for the blank to extend through the zones such that portions of the blank receive different temperature heat from a heat element based on the zones.

10. The furnace of claim 9, wherein the slide mechanism comprises:
- a set of walls disposed on either side of the heat element mounted to a base portion of the housing within the chamber;
- a set of blocks, each of the blocks sized for mounting to one of the walls; and
- one or more rollers extending between the blocks to translate the blank within the chamber internal zone.

11. The furnace of claim 10, further comprising a divider defining one or more cutouts to receive a portion of each wall of the set of walls and a divider opening sized to receive the blank, wherein the divider is sized for translation along the set of walls and such that the divider separates the chamber internal zone into two separate zones.

12. The furnace of claim 11, wherein the divider is arranged with the visor for a blank to extend through the chamber external zone and each of the two separate zones of the chamber internal zone.

13. The furnace of claim 11, wherein the divider is translatable along the set of walls to define multiple sizes of the two separate zones of the chamber internal zone.

14. The furnace of claim 9 further comprising a visor plug sized for insertion within the visor opening.

15. The furnace of claim 9, wherein the visor includes a first flap and a second flap extending from portions of the housing at the opening and arranged with one another to define the visor opening when in a closed position.

16. The furnace of claim 9, wherein the heat element is arranged with the visor such that a temperature of the chamber external zone is below a phase transformation temperature of the blank.

* * * * *